US010780476B2

(12) United States Patent
Dudas et al.

(10) Patent No.: US 10,780,476 B2
(45) Date of Patent: Sep. 22, 2020

(54) METHOD FOR MAKING MG BRASS EDM WIRE

(71) Applicant: E. Holdings, Inc, Milford, CT (US)

(72) Inventors: David Joseph Dudas, Easton, CT (US); Richard Balon, Mississauga (CA)

(73) Assignee: E. Holdings, Inc, Milford, CT (US)

( * ) Notice: Subject to any disclaimer, the term of this patent is extended or adjusted under 35 U.S.C. 154(b) by 0 days.

(21) Appl. No.: 16/495,430

(22) PCT Filed: Feb. 14, 2019

(86) PCT No.: PCT/US2019/017914

§ 371 (c)(1),
(2) Date: Sep. 19, 2019

(87) PCT Pub. No.: WO2019/164731

PCT Pub. Date: Aug. 29, 2019

(65) Prior Publication Data

US 2020/0061687 A1 Feb. 27, 2020

Related U.S. Application Data

(60) Provisional application No. 62/724,653, filed on Aug. 30, 2018, provisional application No. 62/633,631, filed on Feb. 22, 2018.

(51) Int. Cl.
*B21C 1/02* (2006.01)
*B22D 11/00* (2006.01)
(Continued)

(52) U.S. Cl.
CPC ..... *B21C 1/02* (2013.01); *B22D 11/004* (2013.01); *B22D 11/005* (2013.01); *C22C 9/04* (2013.01); *C22F 1/08* (2013.01)

(58) Field of Classification Search
CPC ..... B22D 11/0665
See application file for complete search history.

(56) References Cited

U.S. PATENT DOCUMENTS 4,207,096 A 6/1980 Suwa et al.
4,287,404 A 9/1981 Convers et al.
(Continued)

FOREIGN PATENT DOCUMENTS

CN 104690381 A * 6/2015
CN 104690381 A 6/2015
(Continued)

OTHER PUBLICATIONS

Espacenet machine translation of KR20080028754 retrieved on Jan. 28, 2020 (Year: 2008).*
(Continued)

*Primary Examiner* — Keith D. Hendricks
*Assistant Examiner* — Joshua S Carpenter
(74) *Attorney, Agent, or Firm* — Mark Nowotarski

(57) ABSTRACT

A method for making Mg brass EDM wire has the steps of melting a charge of Mg brass to form a melt of Mg brass; transferring the melt to a holding furnace; casting a rod from the melt; and drawing the rod down to a size suitable for EDM machining. Mg deposits may form in the holding furnace. These can be removed by flushing the holding furnace with molten brass.

3 Claims, 2 Drawing Sheets

(51) Int. Cl.
*C22C 9/04* (2006.01)
*C22F 1/08* (2006.01)

(56) References Cited

U.S. PATENT DOCUMENTS

| | | | | |
|---|---|---|---|---|
| 4,341,939 | A | 7/1982 | Briffod et al. | |
| 4,631,237 | A | 12/1986 | Dommer et al. | |
| 4,766,280 | A | 8/1988 | Groos | |
| 5,312,498 | A | 5/1994 | Anderson | |
| 5,858,136 | A | 1/1999 | Briffod | |
| 5,945,010 | A | 8/1999 | Tomalin | |
| 6,155,330 | A | 12/2000 | Kinane et al. | |
| 6,348,667 | B2 | 2/2002 | Baumann et al. | |
| 6,578,620 | B1 * | 6/2003 | Trudel | B22D 18/04 164/134 |
| 8,067,689 | B2 | 11/2011 | Tomalin | |
| 8,629,368 | B2 | 1/2014 | Mazumder et al. | |
| 8,895,885 | B2 | 11/2014 | Nothe | |
| 2007/0295695 | A1 | 12/2007 | Tomalin | |
| 2009/0311127 | A1 | 12/2009 | Xu et al. | |
| 2015/0357071 | A1 | 12/2015 | Yen | |
| 2017/0072489 | A1 | 3/2017 | Tsuji et al. | |

FOREIGN PATENT DOCUMENTS

| | | | |
|---|---|---|---|
| CN | 105834533 | B | 8/2016 |
| EP | 0145 196 | B1 | 6/1985 |
| EP | 0 400 561 | A1 | 12/1990 |
| EP | 0 400 561 | B1 | 3/1994 |
| GB | 898543 | | 6/1962 |
| GB | 2516371 | B | 1/2015 |
| JP | 59-170233 | A | 9/1984 |
| JP | 59170233 | | 9/1984 |
| JP | 63-039733 | A | 2/1988 |
| JP | 63150114 | | 6/1988 |
| JP | 04-284947 | A | 10/1992 |
| JP | 08-176707 | A | 7/1996 |
| JP | 11077437 | | 3/1997 |
| JP | 2002038246 | | 2/2002 |
| KR | 20080028754 | | 4/2008 |
| KR | 20080028754 | A * | 4/2008 |

OTHER PUBLICATIONS

Espacenet machine translation of CN104690381 retrieved on Jan. 28, 2020 (Year: 2015).*

A New Angle On Wire EDM: Modern Machine Shop, https://www.mmsonline.com/articles/a-new-angle-on-wire-edm, Case Study Post: Sep. 15, 1995.

Almomani, Tyfour, and Nemrat; Elsevier, Journal of Alloys and Compounds 679 (2016) 104-114, Effect of silicon carbide addition on the corrosion behavior of powder metallurgy Cu-30Zn brass in a 3.5 wt% NaCl solution, last viewed Feb. 13, 2018.

Atsumi, Imai, Li, Kondoh, Kousaka and Kojima; Elsevier Materials Chemistry and Physics 135 (2012) 554-562, Fabrication and properties of high-strength extruded brass using elemental mixture of Cu-40% Zn alloy powder and Mg particle, last viewed Feb. 13, 2018.

English translation of CN 105834533 B, Xianqi et al., Electrode wire used for spark cutting of low-speed wire cutting and preparation method of electrode wire published Aug. 10, 2016.

English translation of JP 2002038246, Takao, Forming and heat trreatment process for copper alloy electric connector material and copper alloy for electric connector material published Feb. 6, 2002.

English translation of KR 20080028754, AM, Brass wire for electrical discharge machining and manufacturing method thereof published Apr. 1, 2008.

Prohaszka, Mamalis, and Vaxevanidis; Elsevier Journal of Materials Processing Technology 69 (1997) 233-237, The effect of electrode material on machinability in wire electro-discharge machining, last viewed Jan. 22, 2018.

Zhu, Wu, Liu, Chen and Chen; Science in China Series E. Technological Sciences Aug. 2009, vol. 52, No. 8, 2172-2174, Study on microsructure and properties of brass containing Sb and Mg, last viewed Jan. 22, 2018.

Kern, Techtips, EDM Wire Primer, Properties of EDM Wires, EDM Today, Jan./Feb. 2007 Issue, last viewed Jan. 22, 2018.

en.wikipedia.org, Electrical discharge machining, https://en.wikipedia.org/wiki/Electrical_discharge_machining, last viewed Jan. 17, 2018.

en.wikipedia.org, Brass, https://en.wikipedia.org/wiki/Brass, last viewed Feb. 15, 2018.

Atlanta EDM®, Wire Sizes used in Wire EDM, What diameter wire do you use?, http://www.atlantaedm.com/faqs/fa14-what-diameter-wire-do-you-use-.php, last viewed Feb. 20, 2018.

American Iron & Alloys, LLC, Advantages of the Continuous Casting Process, Saving Money in the Casting Industry, https://www.versa-bar.com/AlloyInformation/ContinuousCastingProcess, last viewed Jan. 8, 2019.

ASTM Int'l, Desgination: B250/250M-16, Standard Specification for General Requirements for Wrought Copper Alloy Wire, last viewed Jan. 21, 2019.

Berkenhoff GMBH, bedra intelligent wires, Wire solutions for the electronics industry, Square and round wire, Edition Feb. 2013.

Cuijpers, P.F.; TU/e Eindhoven University of Technology, Continuous casting in the copper industry, https://research.tue.nl/en/publications/continuous-casting-in-the-copper-industry, published: Jan. 1, 1987.

English translation of JP 11077437, Takao et al., Electrode wire for wire electric discharge machining and manufacture thereof published Mar. 23, 1997.

English translation of Abstract of JP 59170233, Toshaki et al., Electrode wire for wire electric spark machining published Sep. 26, 1984.

English translation of Specification of JP 59170233, Toshaki et al., Electrode wire for wire electric spark machining published Sep. 26, 1984.

Cochrane and Nairn, The Rautomead Upwards Vertical Continuous Casting Process, Oct. 1995 (edited and updated Nov. 1996).

Rautomead continuouscasting.com, Rautomead brings Cu Mg trolley wire capability to Wire 2008, Dusseldorf Mar. 31-Apr. 4, 2008, Stand No. 10/E56.

English translation of Abstract of JP 63086839, Yoshiaki et al., Electrode wire for wire-cut electric spark machining published Apr. 18, 1988.

International Search Report of US ISA of PCT/US19/17914 dated Apr. 24, 2019.

Written Opinion of the US ISA of PCT/US19/17914 dated Apr. 24, 2019.

Toyo Tanso Co., Ltd., Carbon-Graphite Products, AE-01-03 2018.01.

Hort, Huang, and Kainer; Intermetallics in Magnesium Alloys, Advanced Engineering Materials 2006, 8, No. 4.

Nairn, rautomead, Continuous Casting of Copper Magnesium Conductor Alloys, The paper was presented at the WAI Technical Conference at Interwire, at the Georgian World Congress Center, Atlanta, Georgia, U.S.A., Apr. 25, 2013.

Luo, SciVerse ScienceDirect, Journal of Magnesium and Alloys 1 (2013) 2-22, Magnesium casting technology for structural applications.

Images from the Internet Jun. 26, 2018.

Bagherian et al., University of Dundee, Open Access, "Effect of melt termperature, cleanout cycle, continuous casting direction (horizontal/verical) and super-cooler size on tensile strength, elongation percentage and microstructure of continuous cast copper alloys", publication date 2016, last viewed Mar. 27, 2020.

Karunakar, Department of Mechanical and Industrial Engineering, Indian Institute of Technology, Roorkee, "Module—05 Permanent Mould and Special Casting Processes Lecture—05 Continuous Casting Process", last viewed Mar. 27, 2020.

Harkki et al., Metallurgical and Materials Transactions B, vol. 30B, Feb. 1999, "Mathematical Modeling of Copper and Brass Upcasting", last viewed Mar. 31, 2020.

(56) References Cited

OTHER PUBLICATIONS

Library of Congress; Photo, Print, Drawing; "Conversion. Copper and brass processing. Casting a billet from an electric furnace . . . ", https://www.loc.gov/item/2017690413/, last viewed Apr. 13, 2020.
Mahmood Alam, Deptt. Of Mechanical Engg. Integral University Lucknow, "Non-Ferrous Metals and Alloys, Lecture Notes on manufacturing Process", last viewed Feb. 27, 2020.
Formal English language translation of CN 104690381A, "Low-magnesia unidirectional travelling cutting line and method for manufacturing the same", published Jun. 10, 2015.
Hallem & Kadhim, International Journal of Mechanical and Production Engineering Research and Development (IJMPERD), "Improving Oxidation Behavior of (Alpha-Beta) (Cu-Zn40) Brass by Aluminum Addition", last viewed Feb. 27, 2020.
Formal English language translation of KR 20080028754, "Electrode Wire for Electrical Discharge Machining and Manufacturing Method Therefor", published Apr. 1, 2008.
Liu et al., Elsevier, Corrosion Science, "Flammability and the oxidation kinetics of the magnesium alloys AZ31, WE43, and ZE10", pp. 177-185, last viewed Feb. 27, 2020.
English translation of JP 59-170233 A, "Electrode wire for wire electric spark machining", publication date Sep. 26, 1984.
English translation of JP 08-176707 A, "Electrode wire for wire electric discharge machining"publication date Jul. 7, 1996.
English translation of JP 04-284947 A, "Continuous casting method", publication date Oct. 9, 1992.
Enlglish translation of JP 63-039733 A, "Electrode wire for wire electric spark machining", publication date Feb. 20, 1988.
Japanese Patent Office Notice of Reasons for Rejection dated Jul. 21, 2020 for patent application No. 2019-555217.
English translation of Japanese Patent Office Notice of Reasons for Rejection dated Jul. 21, 2020 for patent application No. 2019-555217.
Claims filed for PCT/US19/17914 on Feb. 14, 2019 and considered for Japan patent application No. 2019-555217.

* cited by examiner

METHOD FOR MAKING MG BRASS EDM WIRE

TECHNICAL FIELD

The inventions described herein are in the field of wire manufacture.

BACKGROUND ART

It has been discovered that additions of magnesium (Mg) to brass provide an alloy that gives improved performance when formed into a wire for electric discharge machining (EDM). The brass may have zinc (Zn) concentrations in the range of 5 wt % to 50 wt %. Suitable magnesium additions may be in the range of 0.02 wt % to 5 wt %. The balance of the alloy is copper (Cu) and inevitable impurities. The concentration of copper in the balance may be in the range of 45 wt % to 95 wt %. We refer to alloys with compositions in this range as "magnesium brass" or "Mg brass".

It is difficult to make Mg brass EDM wire using conventional continuous casting systems and methods designed to produce pure brass EDM wire. The Mg tends to separate out from the alloy when it is melted. Deposits tend to form on casting dies. The wire itself tends to be more difficult to coil and draw into a fine wire suitable for EDM. EDM wires typically have a diameter in the range of 0.1 mm to 0.3 mm. Larger and smaller diameters may be suitable for different applications. Hence there is a need for an improved system and method for producing Mg brass EDM wires.

SUMMARY OF INVENTION

The summary of the invention is a guide to understanding the invention. It does not necessarily describe the most generic embodiment.

FIG. 1 is a schematic of an improved system 100 for producing Mg brass EDM wires. The system comprises:

a) a melting furnace 110 comprising:
- i. a heated body 102;
- ii. a cover 104;
- iii. a source 106 of an inert gas adapted to purge said melting furnace of air; and
- iv. a mixer 108;

b) a holding furnace 130 comprising:
- i. a body 122;
- ii. a cover 124;
- iii. a source 126 of an inert gas adapted to purge said holding furnace of air; and
- iv. a casting die 132;

c) an annealing furnace 150 comprising:
- i. a heated body 142; and
- ii. a source 144 of an inert gas adapted to purge said annealing furnace of air; and d) one or more drawing dies 170 wherein said system is adapted to make a Mg brass EDM wire by the steps comprising:

e) add a bulk charge 112 of copper and zinc to said melting furnace;

f) add an additive charge 114 of magnesium to said melting furnace;

g) heat said bulk charge and said additive charge until they form a melt of Mg brass;

h) stir 101 said melt with said mixer;

i) tap 131 said melting furnace to transfer said melt of Mg brass to said holding furnace;

j) cast said melt of Mg brass through said casting die to form a solid rod 141 of said Mg brass;

k) anneal said rod in said annealing furnace; and l) draw said annealed rod through said one or more drawing dies to form said Mg brass EDM wire 161.

BEST MODE FOR CARRYING OUT THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the term "substantially" means at least 90% of a desired value unless specifically indicated otherwise.

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

As used herein, the term "shaped" means that an item has the overall appearance of a given shape even if there are minor variations from the pure form of said given shape.

As used herein, the term "generally" when referring to a shape means that an ordinary observer will perceive that an object has said shape even if there are minor variations from said shape.

As used herein, relative orientation terms, such as "up", "down", "top", "bottom", "left", "right", "vertical", "horizontal", "distal" and "proximal" are defined with respect to an initial presentation of an object and will continue to refer to the same portion of an object even if the object is subsequently presented with an alternative orientation, unless otherwise noted.

Figure 1:
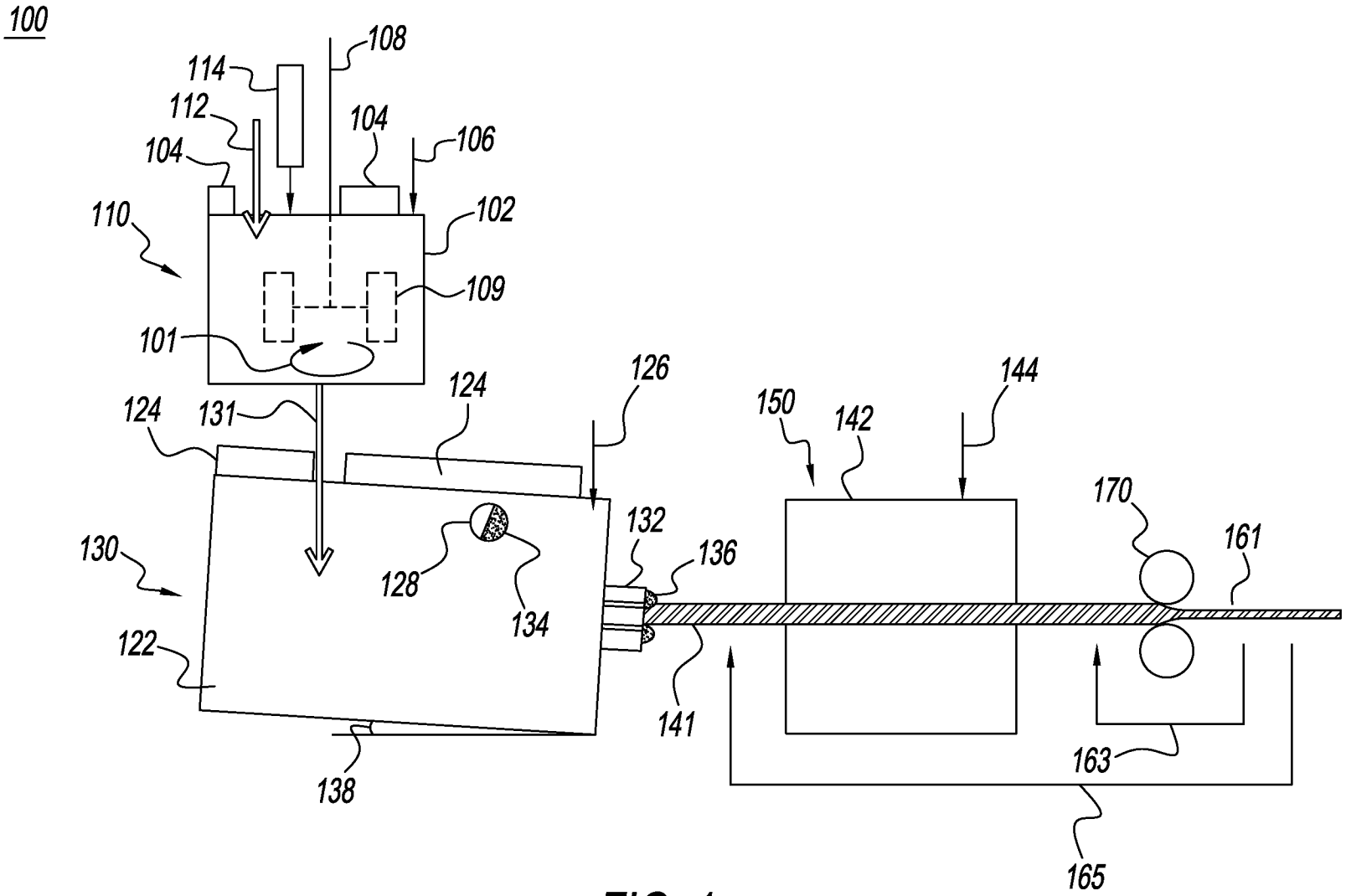
FIG. 1 is a schematic of an improved system and method for producing Mg brass EDM wire.

Referring again to FIG. 1, the bulk charge 112 may comprise a mixture of copper and zinc with 5 wt % to 50 wt % of the total charge being zinc. The total charge is the bulk charge plus the additive charge. Alternatively, the zinc may be in the range of 30 wt % to 40 wt % of the total charge. Alternatively, the zinc may be about 35 wt % of the total charge.

The additive charge may comprise a charge of magnesium in a container of copper or brass. The charge of magnesium may be in the range of 0.02 wt % to 5 wt % of the total charge. The charge of magnesium may be in the range of 0.05 wt % to 0.5 wt % of the total charge. The charge of magnesium may be about 0.1 wt % of the total charge. The bulk charge may be added to the melting furnace first and then melted. The additive charge may be added after the bulk charge has melted.

The mixer may stir the melt after the additive charge is added to the melted bulk charge to reduce the separation of the Mg from the melt. Mixing may be done by any means such as a paddle mixer 109 illustrated in FIG. 1. Mixing may be done alternatively or in combination with any mechanical mixer, any gas mixer (e.g. a bubbler), or any induction mixer (e.g. inductive coupling between the melt and an induction coil in proximity to or integral to the melting furnace).

The cover 104 may be placed on the melting furnace and the space below the cover of the melting furnace may be purged with an inert gas. As used herein, an "inert gas" is any gas mixture with an oxygen concentration less than that of air. For example, a mixture of nitrogen with 1 vol % oxygen produced by a membrane nitrogen generator is considered inert. An inert gas may comprise reducing gases such as hydrogen or carbon monoxide.

After the additive and bulk charge have been melted, the melting furnace may be tapped 131 and the melt transferred to the holding furnace 130. The holding furnace may comprise a body 122 which may be heated. The holding furnace may further comprise a cover 124 and a source 126 of an inert gas. The inert gas for the holding furnace may or may not be the same composition as the inert gas for the melting furnace. For example, the inert gas for the melting furnace may be argon and the inert gas for the holding furnace may be nitrogen.

The holding furnace may further comprise one or more vents 128 and a casting die 132. The holding furnace may further comprise a tilt mechanism 138 so that the holding furnace may be tilted as it empties to provide a constant head pressure at the casting die. As the holding furnace empties, a new bulk and additive charge may be added to the melting furnace and melted to produce a new melt. Before the holding furnace is emptied, the new melt may be transferred to said holding furnace to keep the casting process running continuously. The tilt mechanism may adjust so that the head pressure at the casting die is constant.

After the rod 141 is cast, it may be fed directly into an in-line annealing furnace. The annealing furnace may be purged with an inert gas. The inert gas for the annealing furnace may be different than the inert gasses for either the melting furnace or holding furnace. The inert gas for the annealing furnace, for example, may comprise nitrogen and about 1 vol % hydrogen.

Alternatively, the rod may be coiled after it is cast. The coiled rod may then be fed into a batch annealing furnace, such as a bell furnace. Coiling the rod allows it to be stored so that it can be drawn down to a wire at a later time.

After the rod is annealed, it may be passed through one or more drawing dies 170 to form a quantity of Mg brass EDM wire 161. The system may comprise a plurality of drawing dies with progressively smaller diameters. The step of drawing said annealed rod may comprise the steps of re-drawing 163 said rod through each of said plurality of drawing dies. The step of drawing said annealed rod may further comprise the step of re-annealing 165 said rod after it has been drawn through one or more of said plurality of drawing dies. For example, the rod may be re-annealed after being drawn through three drawing dies. The re-annealing may be done in a different annealing furnace (not shown) than the annealing furnace 150 that was initially used to anneal the cast rod 141. The different annealing furnace may be a batch furnace (e.g. a bell furnace) or an inline furnace (e.g. a double open-ended furnace).

Once the Mg brass wire has reached its desired final diameter, it may be coiled and shipped.

Flushing Deposits from Holding Furnace

It has been found by experiment that when Mg brass is cast from a holding furnace, deposits 134, 136 may be formed around the vents and casting die respectively. The deposits may comprise magnesium.

Figure 2:
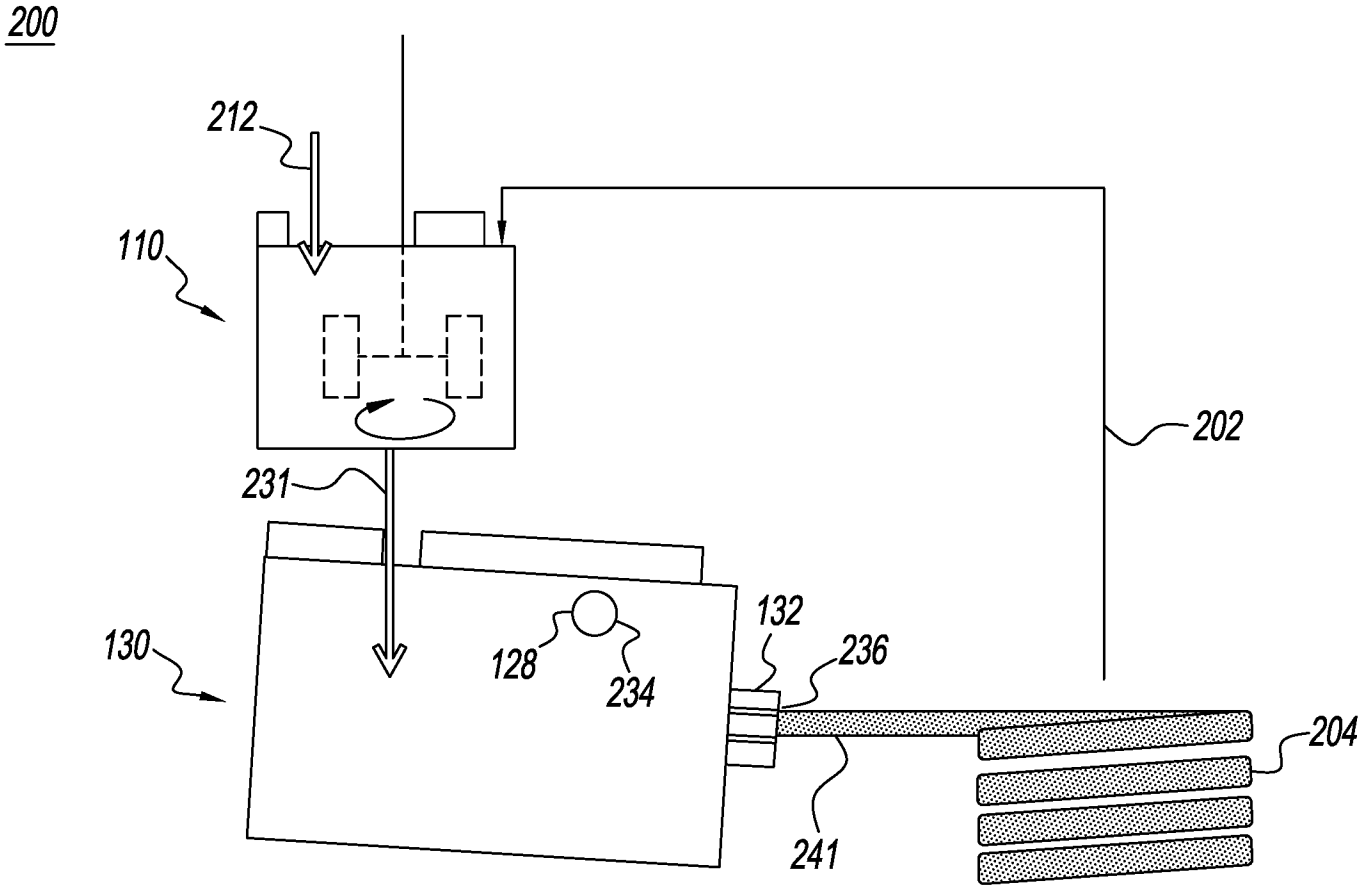
FIG. 2 is a schematic of a system and method for removing deposits comprising Mg from a casting die and recycling said deposits into a subsequent melt of Mg brass.

FIG. 2 is a schematic of a system and method 200 for removing the Mg deposits and recycling them for a future Mg brass melt. It has been surprisingly found that the deposits can be removed by the steps of:

a) after a melt of Mg brass has been cast into a rod, add a second bulk charge 212 of flushing metal to the melting furnace 110, said flushing metal being operable to dissolve the deposits that may have formed on the casting die and/or vent;

b) heat said second bulk charge to form a melt of flushing metal;

c) transfer 231 said melt of flushing metal to said holding furnace 130; and d) cast a rod 241 of flushing metal from said flushing melt through said casting die 132 such that said deposits that may have formed on said casting die and/or said vent are removed 234, 236 and dissolved in said flushing melt.

Said rod of flushing metal may be formed into a coil 204.

The flushing metal may be brass substantially comprising copper and zinc at about the desired concentrations in said Mg brass wire. The coil may then be returned 202 to said melting furnace and melted for a second melt of Mg brass. The composition of said flushing metal may be measured and additional Mg added to the melt to achieve a desired concentration of Mg. The second melt of Mg brass may then be transferred to the holding furnace and cast into a second rod of Mg brass. The second rod of Mg brass may then be drawn through one or more drawing dies to form a second quantity of Mg brass EDM wire.

In an alternative embodiment, pure copper is used as the flushing metal. When the flushing rod is recycled to the melting furnace, both zinc and Mg may be added to make a second melt of Mg brass.

In another alternative embodiment, the flushing melt can comprise any metal that will dissolve Mg deposits.

Casting Die

The casting die may be made from graphite or any other suitable material. It has been found by experiment that a graphite die suitable for casting a brass rod may wear out quickly when used to cast Mg brass. It has been surprisingly found that when the graphite die is coated, that the die life is substantially increased. Suitable coatings include phenolic resin and phosphorus.

Coated Wires

Mg brass EDM wires may be subsequently coated. Suitable coatings are copper, zinc, and alloys thereof. If the Mg brass EDM wires are coated with Zn, they may be subsequently annealed to form gamma or epsilon brass coatings. Both coated and uncoated wires are suitable for use in EDM machines with feedback control on the cutting speed that increases the speed until wire breakage. The EDM machine then sets the cutting speed to a slightly lower value. The wires are also suitable for use in EDM machines with auto-threading. It has been found by experiment that Mg brass wires auto-thread more reliably than conventional brass wires.

Example 1

A charge of brass was melted in a melting furnace. The copper content was about 64.5 wt %. This was about the desired copper concentration of 65 wt %. The balance of the melt was zinc and inevitable impurities. Hence the zinc content was about 35.5 wt %. This was about the desired zinc concentration of 35 wt %. Mg was added to the heat to bring the Mg content to about 0.1 wt %. This was about the desired Mg concentration of 0.1 wt %. This made a first melt of Mg brass. The first melt was transferred to a holding furnace and cast into a first rod of Mg brass. The first rod of Mg brass was annealed and drawn down to make a first quantity of Mg brass EDM wire with a diameter of about 0.25 mm.

After the first melt of Mg brass was cast, deposits were observed on the holding furnace vents and casting die. A charge of flushing metal was added to the melting furnace and melted to form a melt of flushing metal. The flushing metal had about the same copper and zinc content as the first melt of Mg brass. The flushing melt was transferred to the holding furnace and a flushing rod was cast. The deposits on both the vent and the casting die were dissolved in the flushing melt.

A user placed the first quantity of Mg brass EDM wire in an EDM cutting machine with auto-treading. Relative to regular brass wire, the Mg brass EDM wire cut 20% faster, had fewer breaks and had consistent and reliable auto-threading. While not wanting to be held to the explanation, the better auto-threading may be related to having the zinc concentration at a level of about 35 wt %. This is close to the upper limit for having a pure alpha phase brass in an Mg free brass alloy. When Mg is added, this may cause property changes that make the wire stiffer and provide more consistent auto-treading.

It was also observed that the metal part that was cut in the EDM cutting machine had a smoother finish than when the same metal was cut with brass EDM wire with no added magnesium. It was also observed that fewer deposits were formed within the water bath of the EDM machine relative to regular brass EDM wire.

Example 2

Continuing with Example 1, after the flushing rod was cast, the flushing rod was transferred back to the melting furnace and melted. The Mg content was measured and enough Mg was added to bring the Mg content to about the desired concentration of 0.1 wt % to make a second melt of Mg brass. The second melt was then transferred to the holding furnace and cast into a second rod of Mg brass. The rod was then annealed and drawn through one or more drawing dies to form a second quantity of Mg brass EDM wire. The diameter of the Mg brass EDM wire was about 0.25 mm. This was in the desired range of 0.1 to 0.3 mm.

A user placed the second quantity of Mg brass EDM wire in an EDM cutting machine with auto-threading. Relative to regular brass wire, the second quantity of Mg brass EDM wire cut 20% faster, had fewer breaks and had consistent and reliable auto-threading. It was also observed that the article that was cut in the EDM cutting machine had a smoother finish than when the same article was cut with brass EDM wire with no added magnesium. It was also observed that fewer deposits were formed within the water bath of the EDM machine relative to regular brass EDM wire.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. For example, a rod of Mg brass may be cast vertically instead of horizontally. Therefore, it is intended that the disclosure not be limited to the particular embodiment disclosed as the best mode contemplated for carrying out this invention.

We claim:

1. A method for making Mg brass EDM wire comprising the steps:

a) in a melting furnace, melt a first charge of Mg brass to form a first melt of Mg brass comprising:
   i) zinc at a first zinc concentration in the range of 5 wt % to 50 wt %;
   ii) magnesium at a first magnesium concentration in the range of 0.02 wt % to 5 wt %; and
   iii) copper at a first copper concentration in the range of 45 wt % to 95 wt %;

b) transfer said first melt of Mg brass to a holding furnace comprising a casting die suitable for continuously casting a rod;

c) continuously cast a first rod of Mg brass through said casting die thereby forming deposits comprising Mg on said casting die;

d) draw said first rod of Mg brass through one or more drawing dies to form a quantity of said Mg brass EDM wire;

e) after said first rod of Mg brass is cast, melt a charge of copper or brass in said melting furnace to form a melt of flushing metal, said melt of flushing metal being operable to dissolve said deposits;

f) transfer said melt of flushing metal to said holding furnace; and g) cast a rod of flushing metal from said holding furnace such that said deposits are substantially removed from said casting die.

2. The method of claim 1 wherein said first zinc concentration is about 35 wt % and said first magnesium concentration is in the range of 0.02 wt % to 5 wt %.

3. The method of claim 1 wherein said first zinc concentration is about 35 wt % and said first magnesium concentration is in the range of 0.05 wt % to 0.5 wt %.

* * * * *